US012693085B2

(12) United States Patent
Matonti

(10) Patent No.: US 12,693,085 B2
(45) Date of Patent: Jul. 28, 2026

(54) ACCESSORY FOR A FIREARM, AND FIREARM

(71) Applicant: Ghyslain Matonti, Plan-d'Orgon (FR)

(72) Inventor: Ghyslain Matonti, Plan-d'Orgon (FR)

( * ) Notice: Subject to any disclaimer, the term of this patent is extended or adjusted under 35 U.S.C. 154(b) by 0 days.

(21) Appl. No.: 19/127,130

(22) PCT Filed: Nov. 3, 2023

(86) PCT No.: PCT/EP2023/080694

§ 371 (c)(1),
(2) Date: May 5, 2025

(87) PCT Pub. No.: WO2024/094864

PCT Pub. Date: May 10, 2024

(65) Prior Publication Data

US 2026/0168751 A1 Jun. 18, 2026

(30) Foreign Application Priority Data

Nov. 4, 2022 (FR) ..... 2211508

(51) Int. Cl.
*F41A 9/60* (2006.01)

(52) U.S. Cl.
CPC ..... *F41A 9/60* (2013.01)

(58) Field of Classification Search
CPC ..... F41A 9/60
USPC ..... 42/98, 106
See application file for complete search history.

(56) References Cited

U.S. PATENT DOCUMENTS

| | | | | |
|---|---|---|---|---|
| 4,594,803 | A * | 6/1986 | Muncy | F41A 9/60 42/98 |
| 7,043,863 | B2 * | 5/2006 | Saur | F41A 9/60 42/98 |
| 7,941,961 | B1 * | 5/2011 | Cooper | F41G 11/003 42/98 |
| 9,360,264 | B2 * | 6/2016 | Rosenthal | F41A 9/54 |
| 2015/0316338 | A1 * | 11/2015 | Rosenthal | F41A 9/54 42/98 |
| 2023/0400270 | A1 * | 12/2023 | Nicolajsen | F41A 9/60 |

FOREIGN PATENT DOCUMENTS

| | | | | |
|---|---|---|---|---|
| CH | 679803 | A5 * | 4/1992 | F41A 9/60 |
| EP | 3598055 | A1 * | 1/2020 | F41A 9/60 |

* cited by examiner

*Primary Examiner* — Reginald S Tillman, Jr.
(74) *Attorney, Agent, or Firm* — Patshegen IP; Moshe Pinchas

(57) ABSTRACT

The accessory (20) attaches to a firearm (15) of predetermined geometry including a casing ejection window (18) defining a path (19) of a casing ejected from the firearm upon firing. The accessory (1) comprises:

a permanent magnet (21), and a support attached to the firearm, configured to position a surface of the permanent magnet in the path of the casing or tangentially to the path of the casing.

8 Claims, 11 Drawing Sheets

ACCESSORY FOR A FIREARM, AND FIREARM

TECHNICAL FIELD OF THE INVENTION

The present invention relates to an accessory for a firearm, and a firearm. It applies, in particular, to the fields of hunting and sport or military shooting. It concerns more specifically the recovery of casings during firing.

STATE OF THE ART

When firing with a firearm that has an ejection window 18 for casings (also called a "cartridge case"), a casing is ejected from the firearm. This lost casing risks injuring a person located in front of the ejection window and polluting the environment. In addition, its high temperature can cause burns. In order to not pollute the environment, the shooter is obliged to bend over and look for the casing to pick it up. Very often, because he has moved between shots, the search for lost casings proves unsuccessful. Moreover, during the search, this phase of inattention to people and animals nearby may contribute to an accident, for example if the shooter is startled by noises in the surrounding foliage.

International patent application WO 2022/090 088, American patent application US 2015/316 338 and U.S. Pat. No. 7,941,961, which disclose devices for retrieving casings, are known.

DESCRIPTION OF THE INVENTION

The present invention aims to remedy all or part of these drawbacks.

To this end, according to a first aspect, the present invention envisions an accessory for a firearm of predetermined geometry including a casing ejection window defining a path of a casing ejected from this firearm upon firing, which accessory comprises:

- a permanent magnet, and
- a support attached to the firearm, configured to position a surface of the permanent magnet in the path of the casing or tangentially to the path of the casing, which support comprises a mounting plate attached to the firearm and a removable mounting support bearing the magnet, the mounting support being configured to be secured to the mounting plate in several respective positions along an axis parallel to the axis of the barrel of the firearm, the mounting support being configured to be secured to the mounting plate in several respective positions in a plane perpendicular to the axis of the barrel of the firearm.

Thanks to these provisions, when the casing is ejected, its metallic part passes close to the permanent magnet and is held on the surface of the magnet. The user can therefore retrieve the casing on his firearm directly by hand, without needing to bend down or search to find the casing. In addition, the mounting support, and therefore the magnet, can be positioned more or less in front of or behind the ejection window, and the mounting support, and therefore the magnet, can be positioned more or less below the ejection window. In some embodiments, the support is configured to separate the magnet from the casing ejection window by a distance at least greater than fifty percent of the diameter of a casing used by the firearm.

Thanks to these provisions, once a casing is magnetically held to the magnet, another casing can be ejected through the ejection window without risking being blocked in this window. This other casing therefore bounces onto the first one.

In some embodiments, the support comprises an arm orientable in rotation around an axis parallel to the axis of the barrel of the firearm.

In some embodiments, the articulation comprises a lock for locking the orientation of the arm.

Thanks for each of these provisions, the user can position the magnet more or less facing the casing ejection window and more or less in the path of the casing. Then, he can lock this position.

In some embodiments, the mounting support comprises an element from amongst a star wheel or a notch, and the mounting plate comprises the other element from amongst the star wheel or the notch, the notch engaging between two teeth of the star wheel to define several respective positions around an axis parallel to the axis of the barrel of the firearm.

Thanks to these provisions, the position of the mounting support relative to the mounting plate withstands the vibrations caused by the action of the firearm.

In some embodiments, the mechanical connection between the mounting support and the mounting plate is a screw fastening, the mounting support and/or the mounting plate having at least three openings for the passage of screws.

Thanks to these provisions, the user can easily modify the respective position of the mounting support and the mounting plate.

In some embodiments, the support of the magnet bears at least one magnet in rotation around an axis of rotation parallel to the axis of the barrel of the firearm.

Thanks to these provisions, the set of one or more magnets can retain a plurality of casings by rotation between two ejections of casings, the ejection of a casing causing the rotation of this set of one or more magnets.

According to a second aspect, the present invention envisions a firearm comprising a casing ejection window defining a path of a casing ejected from this firearm upon firing, which firearm comprises:

- a permanent magnet, and
- a support configured to position a surface of the permanent magnet in the path of the casing or tangentially to the path of the casing, which support comprises a mounting plate attached to the firearm and a removable mounting support bearing the magnet, the mounting support being configured to be secured to the mounting plate in several respective positions along an axis parallel to the axis of the barrel of the firearm, the mounting support being configured to be secured to the mounting plate in several respective positions in a plane perpendicular to the axis of the barrel of the firearm.

As the particular features, advantages and aims of this firearm are identical to those of the accessory that is the subject of the invention, they are not repeated here.

BRIEF DESCRIPTION OF THE FIGURES

Other advantages, aims and particular features of the invention will become apparent from the non-limiting description that follows of at least one particular embodiment of the accessory and firearm that are the subjects of the present invention, with reference to drawings included in an appendix, wherein.

DESCRIPTION OF THE EMBODIMENTS

The present description is given in a non-limiting way, in which each characteristic of an embodiment can be combined with any other characteristic of any other embodiment in an advantageous way.

Throughout the description, the term "top" or "upper" refers to what is at the top when the user carries the firearm in an upright firing position, generally at the shoulder or in the hand. An arrow, referenced by "H", indicates the top in each figure: it is therefore the top in FIG. 1. The term "bottom" or "lower" refers to what is at the bottom in these figures and when the firearm is carried by the user standing in a normal firing position. The notions of vertical and height flow from these definitions.

The term "in front of" refers to what is in front of the user in a normal standing firing position, and "behind" refers to what is behind or at the back of the user. The term "front" refers to what one sees looking towards the user when in front of him, and "back" refers to what one sees looking towards the user when behind him. The lengths are measured parallel to the barrel of the firearm, and widths are measured in a direction perpendicular to the barrel and vertical. An arrow, referenced by "H", indicates the direction of measurement for the lengths in the figures. An arrow, referenced by "I", indicates the direction of measurement for the widths in the figures. The term "inner" refers to what is close to or turned towards the barrel or stock of the firearm, and "outer" refers to what is farther from or turned away from this firearm.

Figure 1:
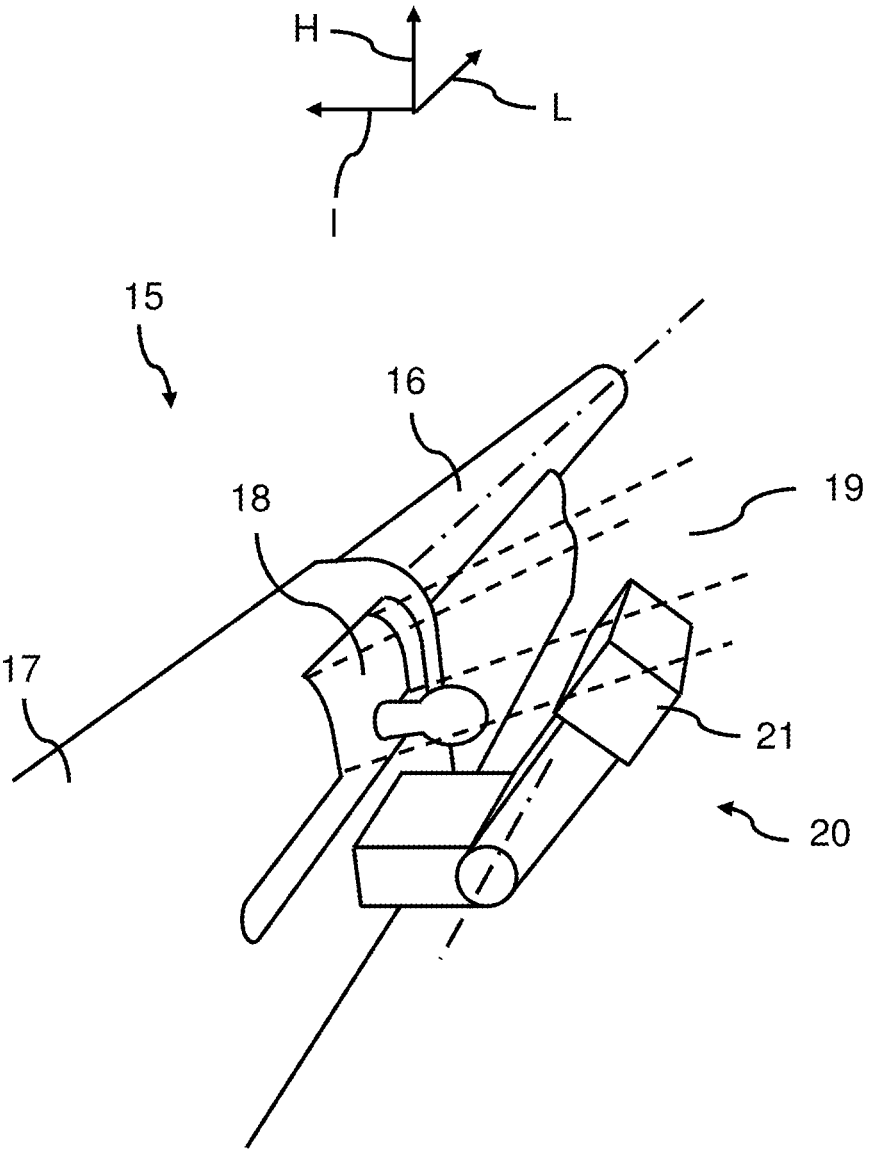
FIG. 1 represents, schematically and in vanishing-point perspective, a firearm that is the subject of the invention equipped with an accessory that is the subject of the invention.
Figure 2:
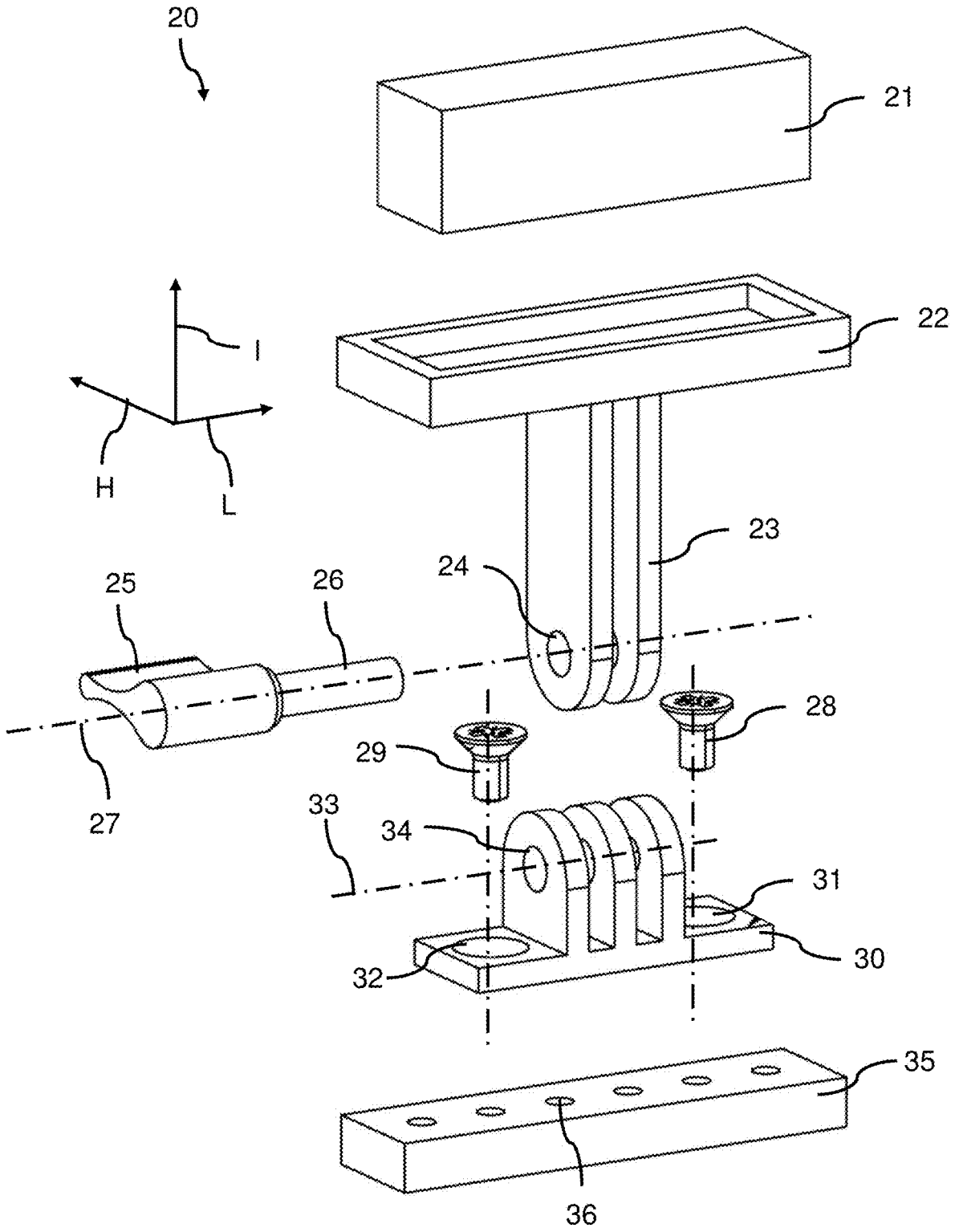
FIG. 2 represents, in exploded perspective, a particular embodiment of the accessory that is the subject of the invention.
Figure 3:
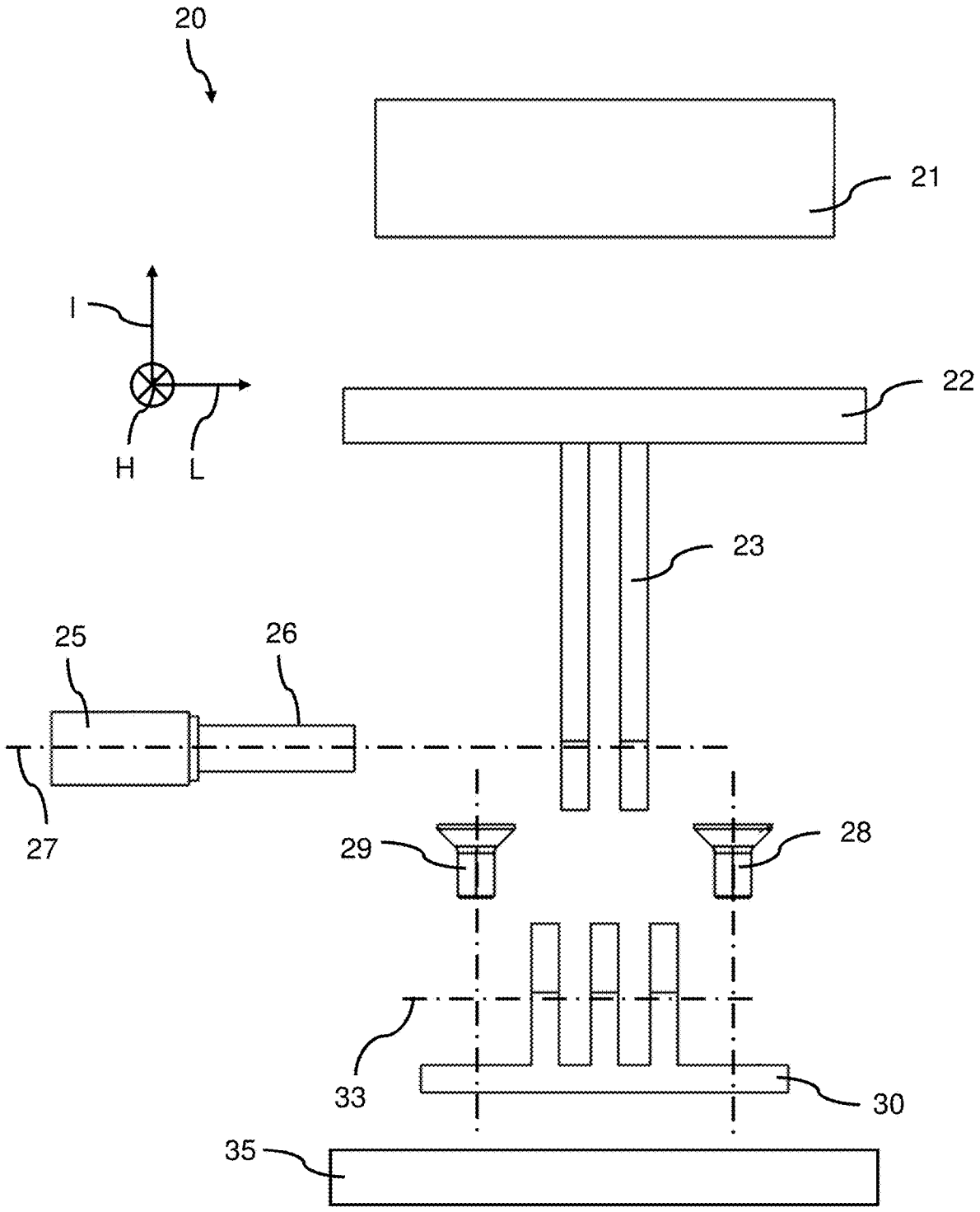
FIG. 3, represents, in an exploded bottom view, the accessory illustrated in FIG. 2.
Figure 4:
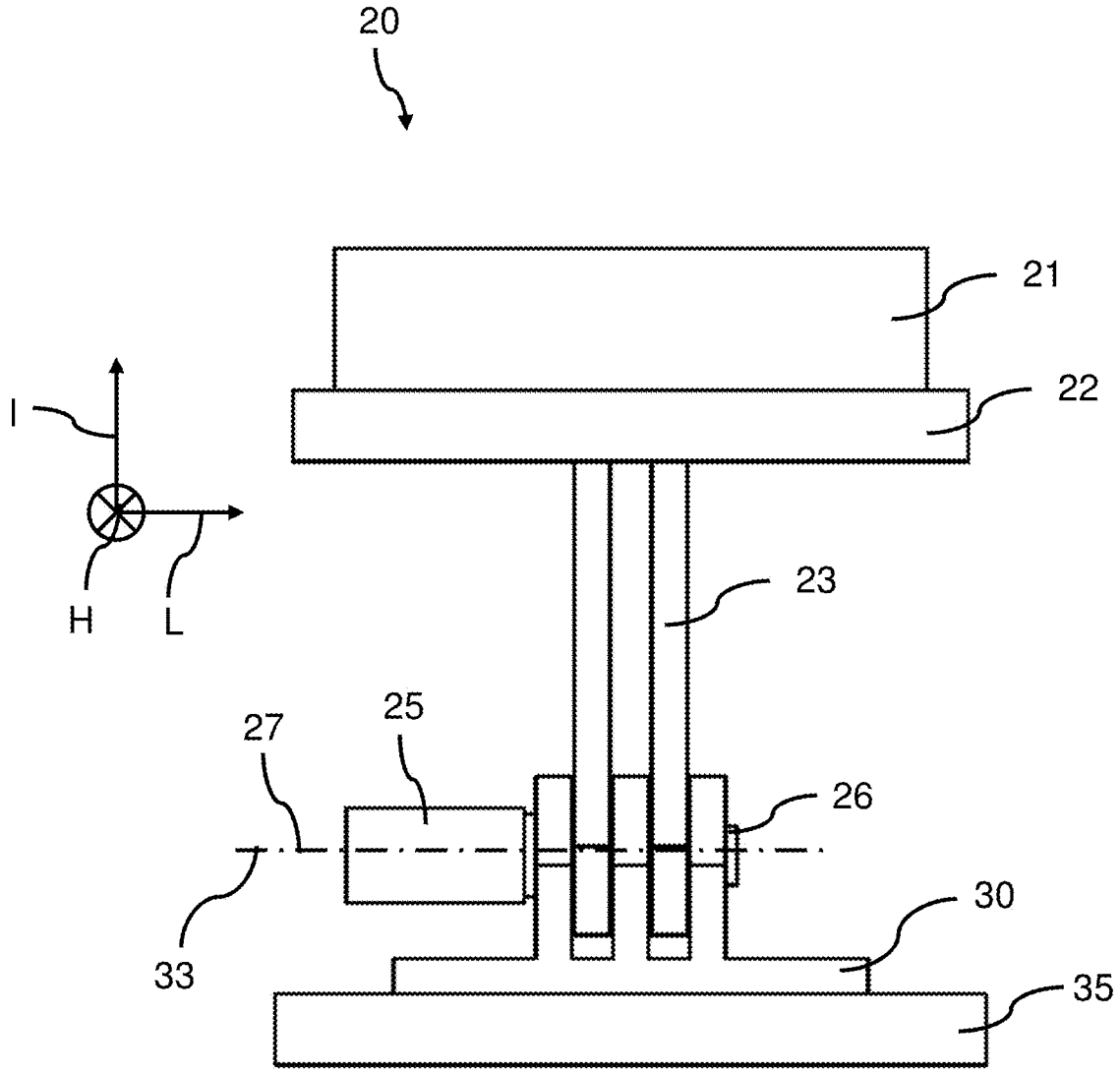
FIG. 4 represents, in a bottom view, the accessory illustrated in FIGS. 2 and 3, mounted in a flat middle configuration.
Figure 5:
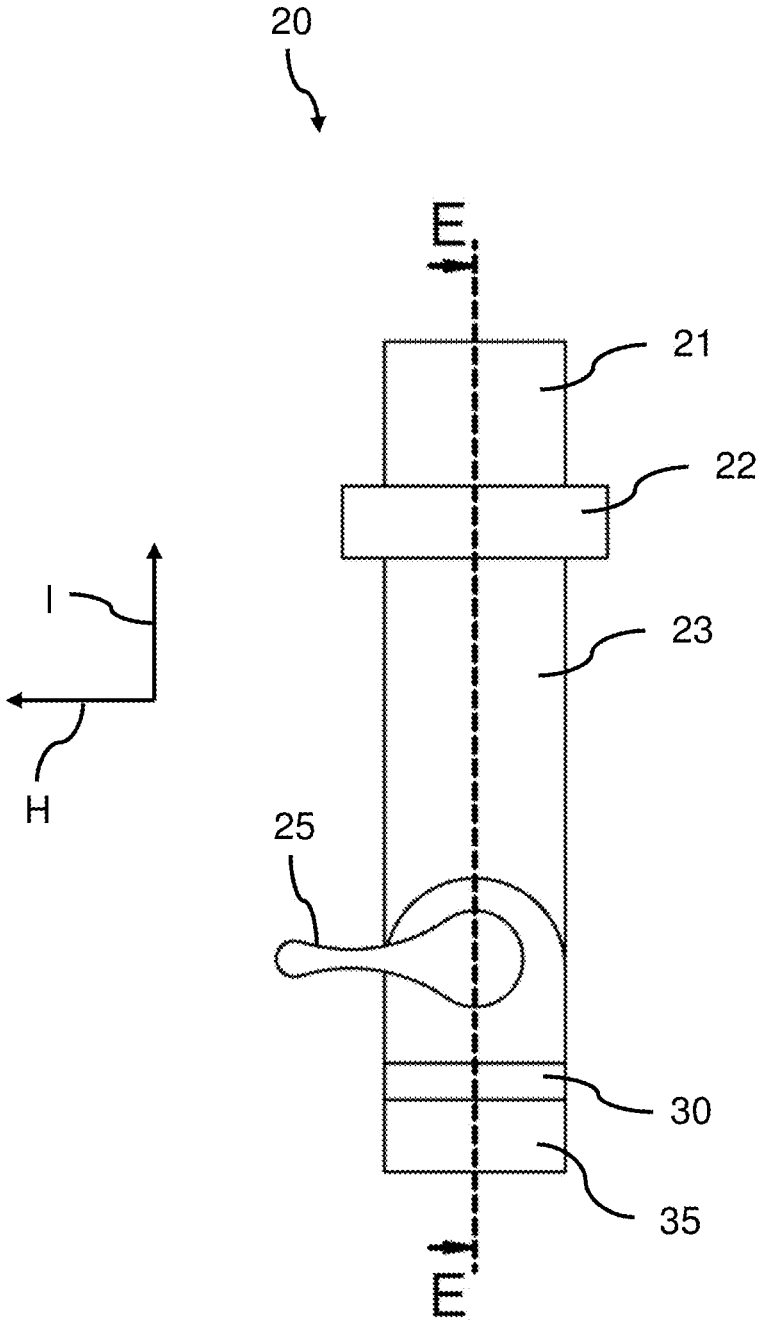
FIG. 5 represents, in a view from the rear, the accessory illustrated in FIGS. 2 to 4, in a flat middle configuration.
Figure 6:
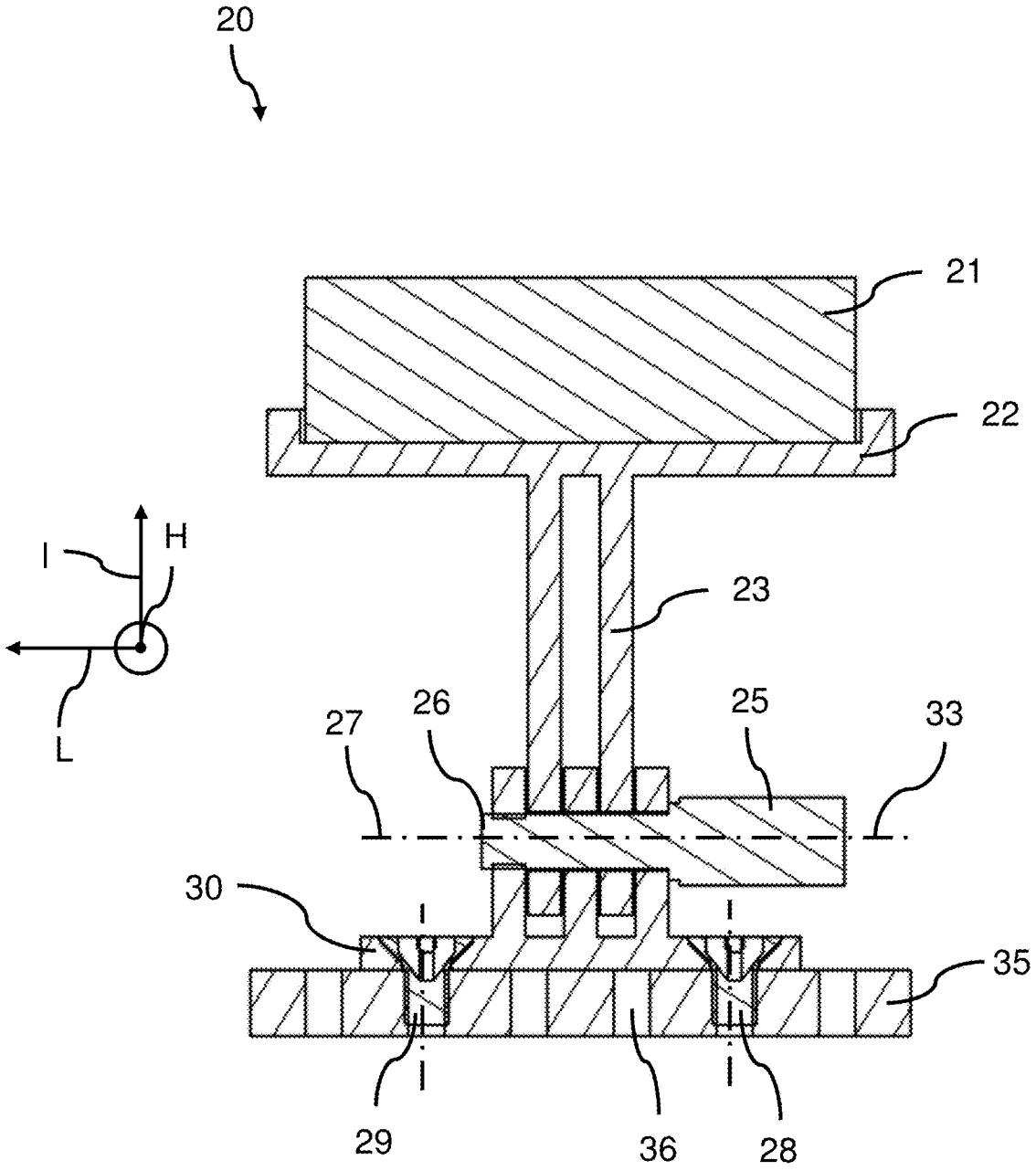
FIG. 6 represents, in a cross-section labelled E-E in FIG. 5, the accessory illustrated in FIGS. 2 to 5, mounted in a flat middle configuration.
Figure 7:
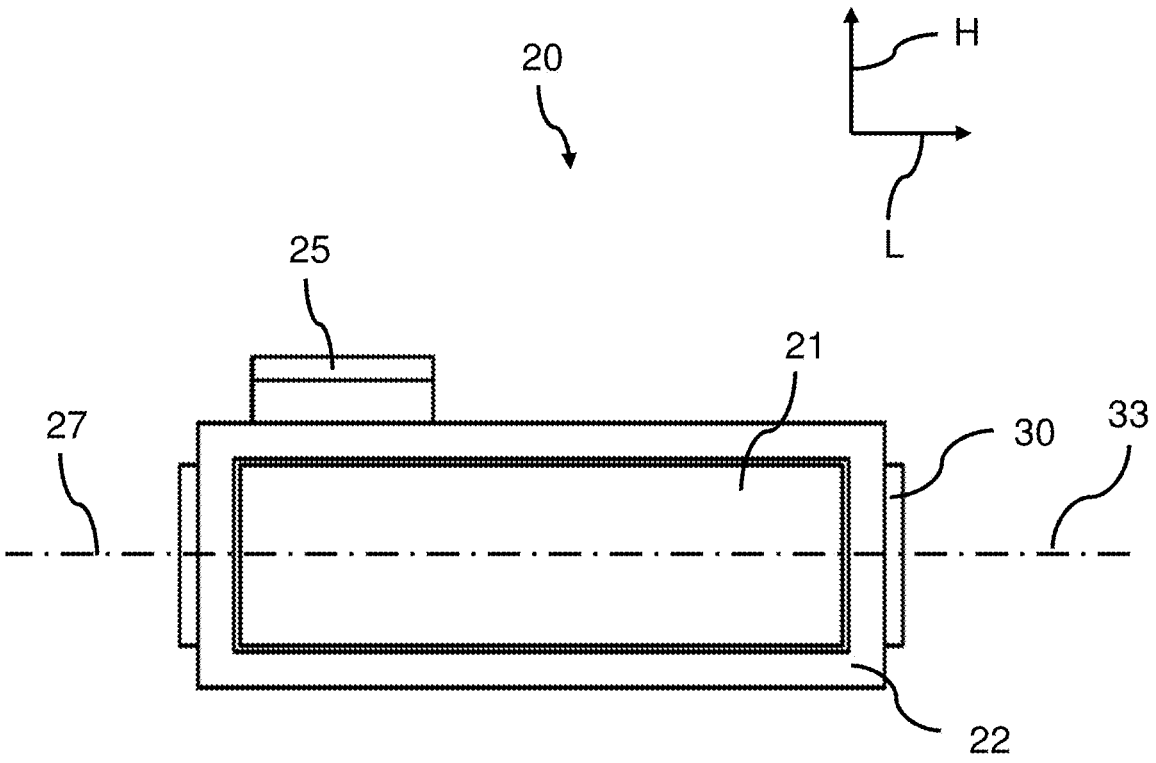
FIG. 7 represents, in a side view, the accessory illustrated in FIGS. 2 to 6, mounted in a flat middle configuration.
Figure 8:
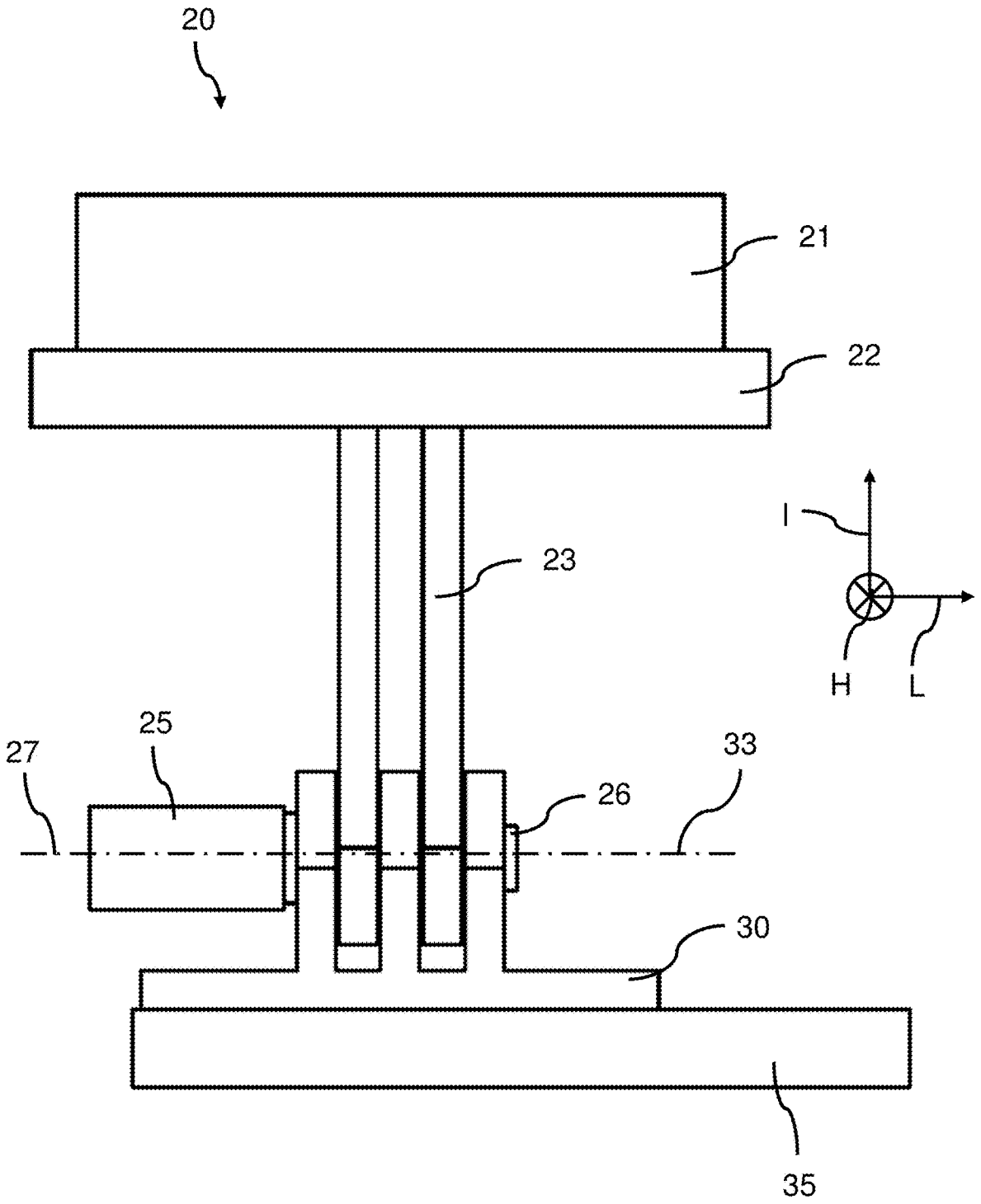
FIG. 8 represents, in a bottom view, the accessory illustrated in FIGS. 2 to 7, mounted in a flat rear configuration.
Figure 9:
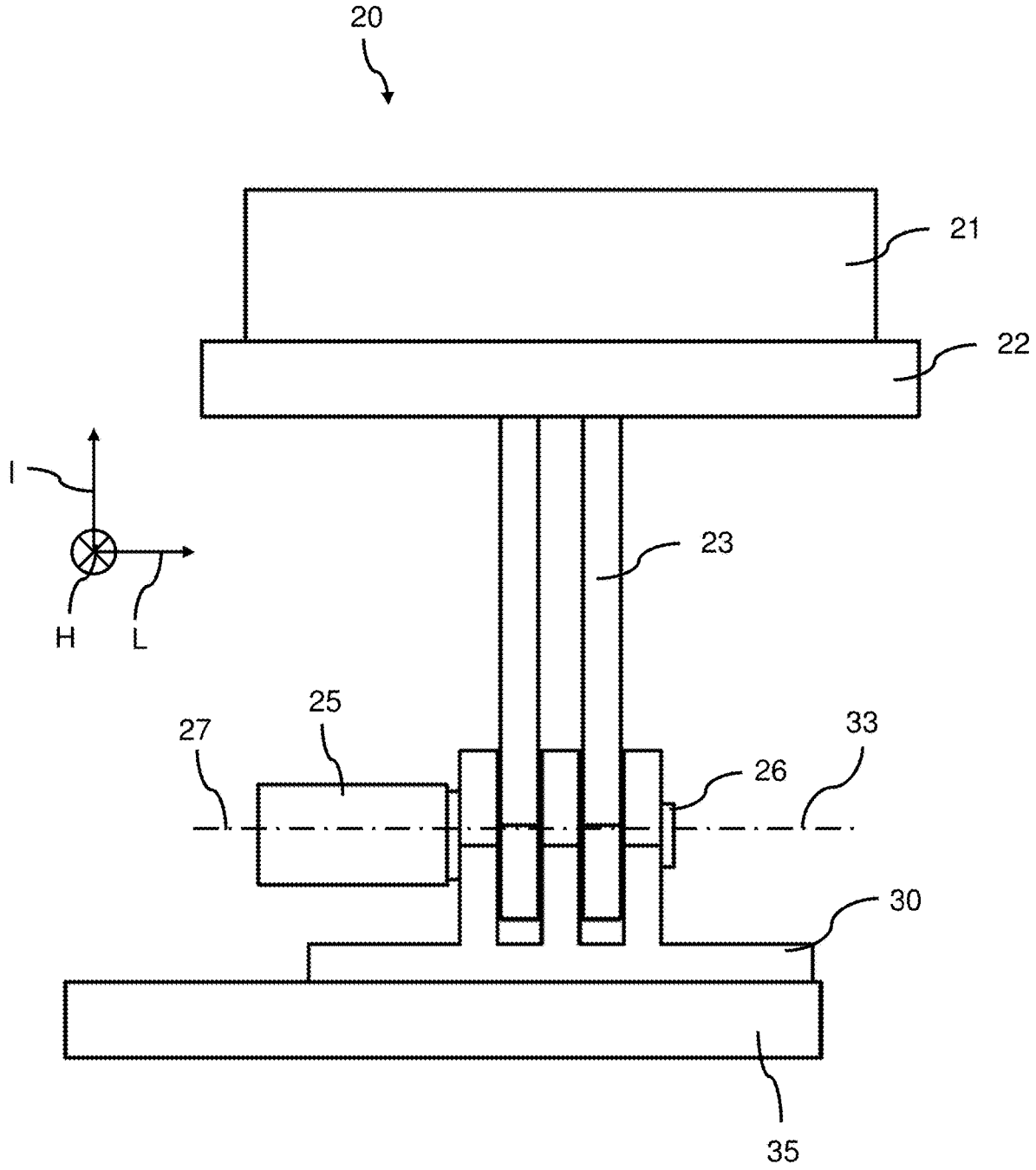
FIG. 9 represents, in a bottom view, the hydrofoil illustrated in FIGS. 2 and 8, mounted in a flat back configuration.

FIG. 1 shows a firearm 15, of shotgun type, equipped with a barrel 16, a stock 17 and an ejection window 18 for casings (also called a "cartridge case"). The casing (not shown) follows a path 19 once it has exited by the ejection window 18. An accessory 20 for a firearm bears a magnet 21, one surface of which is located in the path 19 or tangentially to this path 19.

Although FIG. 1 shows a shoulder-borne firearm, for example a shotgun, the present invention is easily adapted to other types of firearm that have a casing ejection window, for example a pistol.

In the embodiments described with reference to FIGS. 2 to 11, the support 20 comprises an arm orientable in rotation around an axis parallel to the axis of the barrel of the firearm 15. Preferably, this support 20 comprises a lock for locking the orientation of the arm. Therefore, the user can position the magnet more or less facing the casing ejection window and more or less in the path of the casing. Then, he can lock this position. However, in other embodiments (not shown), the support of the magnet is rigid and the position of the magnet relative to the ejection window 18 is fixed and immobilised according to the position of the mechanical connection between the accessory and the firearm 15.

FIGS. 2 to 10 show an accessory 20, which comprises:

- a permanent magnet 21, for example machined and based on neodymium, and more specifically on neodymium, iron and boron,
- a receiver 22 for the magnet 21, for example made of machined aluminium,
- a mounting support 30, for example made of machined aluminium,
- screws 28 and 29, preferably countersunk, for example made of stainless steel,
- a mounting plate 35, for example made of machined aluminium, and
- a mounting key 25, of a type known in ironmongery.

The receiver 22 comprises a housing for the magnet 21, and arms 23 (here two) extending perpendicular to this housing and comprising circular through-openings 24, with axis 27. The mounting support 30 comprises a plate equipped with through-openings 31 and 32 for the passage of the threads of screws 28 and 29. The mounting support 30 is also equipped with arms (here three) extending perpendicular to the plate and comprising cylindrical through-openings with the same diameter as the through-openings 24. The through-openings 34 are positioned on an axis 33.

In some embodiments, a seal, such as a washer made of rubber, is placed around at least through-openings 34, 31 and 32 to increase the coefficient of friction between the arms and to ensure locking.

Figure 11:
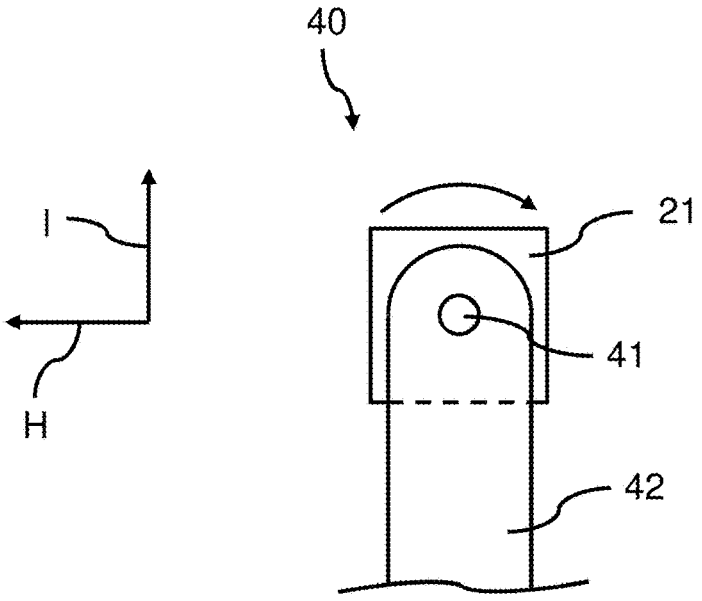
FIG. 11 represents, partially and in a view from the rear, a variant of the embodiment of the accessory that is the subject of the invention illustrated in FIGS. 2 to 10.
Figure 12:
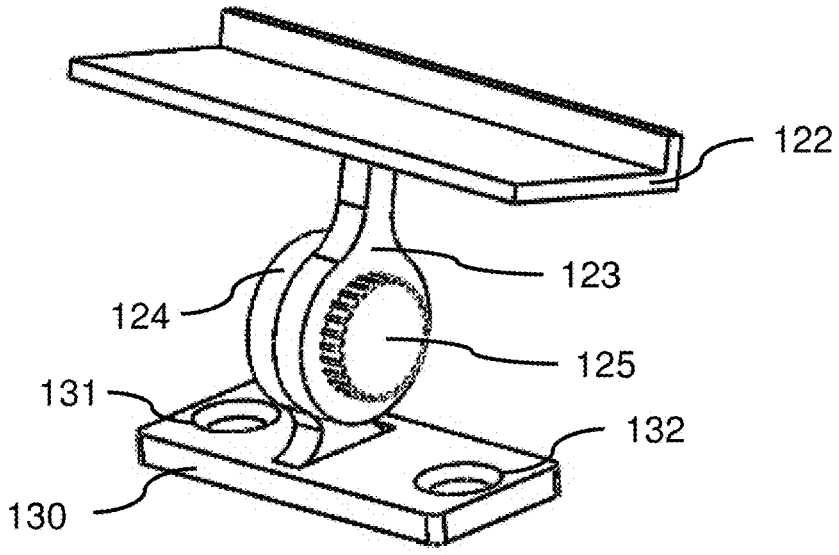
FIG. 12 represents, in perspective, a particular embodiment of the mounting support of the device that is the subject of the present invention.

In some embodiments shown in FIG. 12, the receiver 122 comprises a housing for the magnet, and an arm 123 extending perpendicular to this housing. The housing for the magnet comprises a shoulder, against which the magnet is positioned. The arm 123 comprises a through-opening in which is positioned a star wheel 125 configured to define as many predetermined positions of the receiver 122 as there are notches on the star wheel 125. The mounting support 130 comprises a plate equipped with through-openings 131 and 132 for the passage of the threads of screws 28 and 29. The mounting support 130 is also equipped with an arm 124 extending perpendicular to the plate and comprising cylindrical through-openings with the same diameter as the through-opening of the arm 123 of the receiver 122. The arm 124 is equipped with a notch that engages between at least two teeth of the star wheel 125. In other embodiments, the arm 124 of the plate 130 comprises the star wheel 125, and the arm 123 of the receiver 122 comprises the notch that engages between at least two teeth of the star wheel 125. The embodiments of the receiver, 22 and 122, and the plate, 30 and 130, are compatible. Therefore, in the description above and below, the receiver 122 and the plate 130 have the optional characteristics of the receiver 22 and the plate 30, and are compatible with the embodiments described with reference to FIGS. 1 to 11.

The mounting plate 35 is attached to the breech housing below the ejection window 18 of the firearm 15, for example with double-sided adhesive tape to avoid damaging the firearm. In a variant, the mounting plate is attached above, in front of or behind this window 18. Alternatively, the attachment is made using glue or by tapping the breech housing of the firearm and then attaching with screws. The magnet 21 is attached to the receiver 22 with double-sided adhesive tape, allowing it to be changed if the magnet later becomes damaged. Alternatively, the magnet 21 is glued or is held with a rubber strap, or the magnet is tapped for attachment with screws passing through the appropriate portion of the receiver 22. The magnet 21 can also be tapped and screwed onto the receiver 22. The key 25 locks the position of the receiver 22 thanks to the part 26, which is a threaded rod and is threaded into the last (on the far right in FIG. 2) through-opening 34 of the mounting support 30. The threaded rod 26 therefore serves as a tightening bolt.

Preferably, the support formed of the receiver 22, the mounting support 30 and the mounting plate 35 is configured to separate the magnet 22 from the casing ejection window 18 by a distance at least greater than fifty percent of the diameter of a casing used by the firearm and, preferably at least two times this diameter. In this way, once a casing is magnetically held to the magnet, another casing can be ejected through the ejection window without risking being blocked in this window. This other casing therefore bounces onto the first one.

The key 25 has a handle and a cylindrical shaft 26 with a circular cross-section whose diameter is, with a close clearance, equal to the diameter of the through-openings 24 and 34. The mounting plate 35 is a parallelepiped rectangle and bears tapped holes (here six) whose thread corresponds with the thread of the screws 28 and 29. The distance between the axes of these threaded holes 36 is regular and equal to one third of the distance between the axes of the through-openings 31 and 32. Depending on the choice of threaded holes 36 into which the screws 28 and 29 are inserted, the mounting support 30 can take three positions on the mounting plate 35, respectively shown in FIGS. 4, 8 and 9.

In some embodiments, the mounting plate 35 has a different number of threaded holes 36 than six, and/or the distance between these threaded holes 36 is a fraction (for example, one half or one quarter) other than one third of the distance between the axes of the through-openings 31 and 32. Therefore, the number of respective positions between the mounting support 30 and the mounting plate 35 can be other than three.

In some embodiments, the mounting support 30 comprises more than two through-openings, and the choice of through-openings that actually receive the screws makes it possible to modify the respective position of the mounting support 30 and the mounting plate 35.

More generally, the mechanical connection between the mounting support 30 and the mounting plate 35 is a screw fastening, the mounting support 30 and/or the mounting plate 35 having at least three openings for the passage of screws 28 and 29. The user can therefore easily modify the respective position of the mounting support 30 and the mounting plate 35.

In some embodiments, the mounting support 30 comprises more than one row of through-openings 31 and 32, these rows being parallel and staggered relative to each other in a plane perpendicular to the axis of the barrel of the firearm. These embodiments make it possible to modify, in this plane, the respective position of the mounting support 30 and the mounting plate 35. In some embodiments, the mounting plate 35 comprises more than one row of threaded holes 36, these rows being parallel and staggered relative to each other in a plane perpendicular to the axis of the barrel of the firearm. These embodiments also make it possible to modify, in this plane, the respective position of the mounting support 30 and the mounting plate 35. More generally, the mounting support 30 is configured to be secured to the mounting plate 35 in several respective positions in a plane perpendicular to the axis of the barrel 16 of the firearm 15. In this way, the mounting support 30, and therefore the magnet 21, can be positioned more or less below the ejection window 18.

Of course, the rows of through-openings 31 and 32 and threaded holes 36 can be replaced by rails, e.g. dovetail rails, associated with a locking screw for locking the position of the mounting support 30 in the mounting plate 35.

Thus, the support of the magnet 21 comprises a mounting plate 35 attached to the firearm 15 and a mounting support 30 bearing the magnet 21, the mounting support 30 being configured to be secured to the mounting plate 35 in several respective positions along an axis parallel to the axis of the barrel 16 of the firearm 15.

As shown in FIGS. 4 to 10, once the magnet 21 is mounted in the housing of the receiver 22, when the axes 27 and 33 are aligned and the shaft 26 of the key 25 is inserted into the through-openings 24 and 34 and the screws 28 and 29 into two of the threaded holes 36, through the through-openings 31 and 32, respectively, the accessory is mounted.

Figure 10:
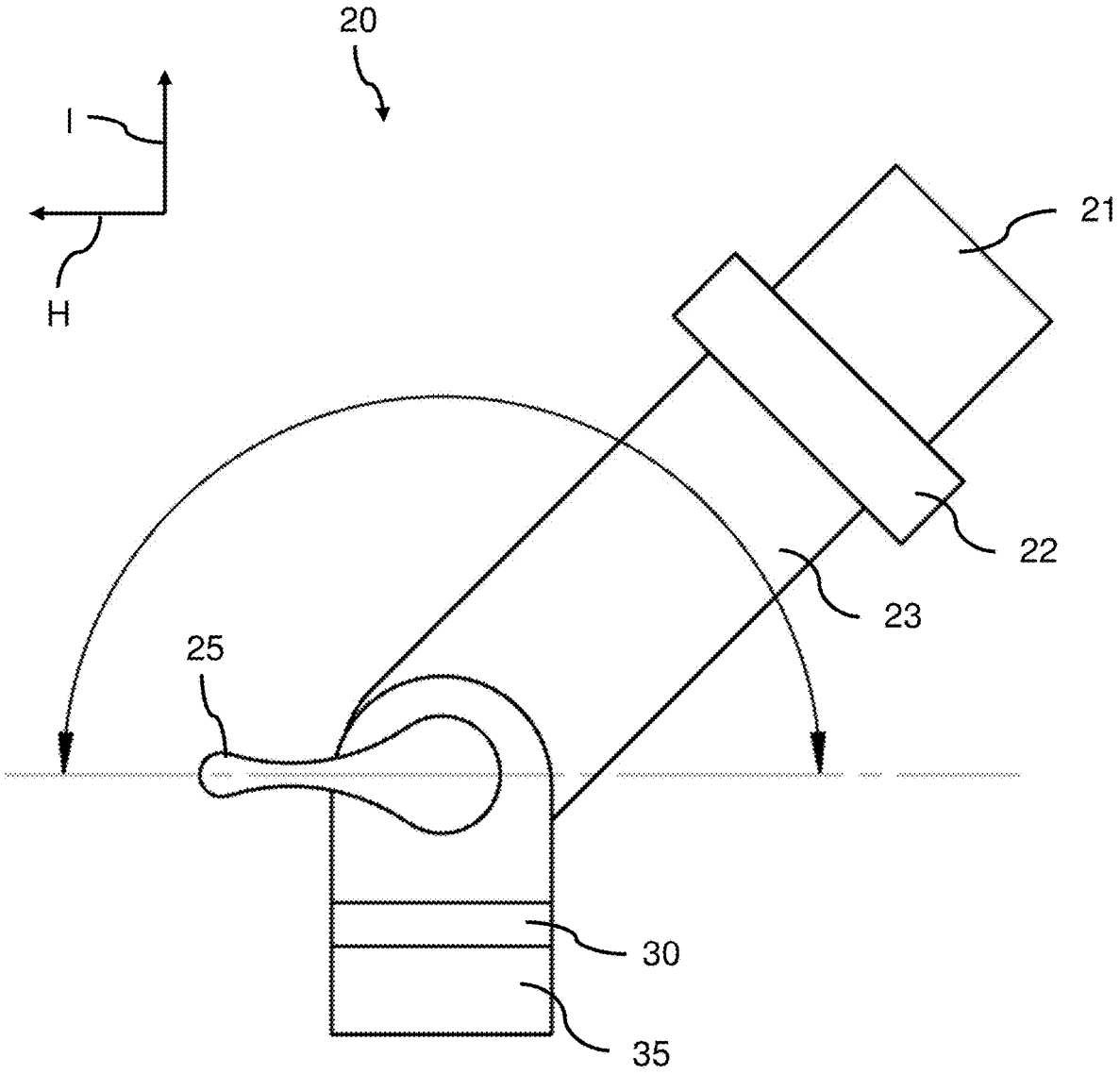
FIG. 10 represents, in a view from the rear, the accessory illustrated in FIGS. 2 and 9, mounted in a curved configuration.

As shown in FIG. 10, the receiver 22 can take different angular positions relative to the mounting support 30 and the mounting plate 35. The user can therefore adjust the position of the magnet 21 relative to the path of the casing 19. For this purpose, the user unlocks the key 25, orients the receiver 22 in the position that suits him, and then relocks the key 25. In FIGS. 2 to 9, the accessory 20 is in a flat configuration, the arms 23 of the receiver 22 being parallel to the arms of the mounting support 30.

Thanks to two or three adjustments:

- longitudinal, by the choice of threaded holes 36 of a row into which the screws 28 and 29 are inserted and/or of through-openings of the mounting support 30 through which the screws 28 and 29 are inserted,
- angular by the action of the key 25, and
- possibly lateral, by the choice of one, from among several, row of threaded holes 36 into which the screws 28 and 29 are inserted, and/or one, from among several, rows of through-openings of the mounting support 30 through which the screws 28 and 29 are inserted, the position of the magnet 21 in the path of the casing 19 can be adjusted to all the paths of the casing, after the mounting plate 35 is roughly mounted on the stock of the firearm 15.

In a first variant shown in FIG. 11, the accessory 40 comprises the magnet 21 mounted on a shaft 41 in a freely rotatable way relative to a receiver 42, additionally similar to the receiver 22 described above, the other parts of the accessory 40 being identical to those of the accessory 20. In this variant, when a casing reaches the magnet 21 and attaches to it by the effect of the magnetic field, its momentum causes the magnet 21 to rotate, so that another casing can then attach to the magnet 21. The user can therefore make several shots before retrieving the casings attached to the magnet 21. In a second variant (not shown), the magnet 21 is replaced by several smaller magnets mounted on a support comprising the shaft 41. The machining of the parts of this second variant can be easier than for the first variant shown in FIG. 11.

As can be seen by reading the description above, the accessory that is the subject of the invention is geometrically defined for a type of firearm having a predetermined geometry comprising a casing ejection window defining a path of a casing ejected from this firearm upon firing.

This accessory mainly comprises:

a permanent magnet, and a support attached to the firearm, configured to position a surface of the permanent magnet in the path of the casing or tangentially to the path of the casing.

The support can be rigid or, as described above, have adjustments to its geometry so as to be adjustable to several types of firearm and/or to different positions for the attachment of the support on the firearm.

Thus, when the casing is ejected, its metallic part passes close to the permanent magnet and is held on the surface of the magnet. The user can therefore retrieve the casing on his firearm directly by hand, without needing to bend down or search to find the casing.

According to a second aspect, the present invention envisions a firearm 15 comprising a casing ejection window 18 defining a path 19 of a casing ejected from this firearm upon firing. This firearm 15 comprises a permanent magnet 21 and a support 22, 30, 35 configured to position a surface of the permanent magnet 21 in the path 19 of the casing or tangentially to the path 19 of the casing.

The invention claimed is:

1. Accessory for a firearm of predetermined geometry including a casing ejection window defining a path of a casing ejected from this firearm upon firing, which accessory comprises:

a permanent magnet, and a support attached to the firearm, configured to position a surface of the permanent magnet in the path of the casing or tangentially to the path of the casing, which support comprises a mounting plate attached to the firearm and a removable mounting support bearing the magnet, the mounting support being configured to be secured to the mounting plate in several respective positions along an axis parallel to the axis of the barrel of the firearm, the mounting support being configured to be secured to the mounting plate in several respective positions in a plane perpendicular to the axis of the barrel of the firearm.

2. Accessory according to claim 1, wherein the support is configured to separate the magnet from the casing ejection window by a distance at least greater than fifty percent of the diameter of a casing used by the firearm.

3. Accessory according to claim 1, wherein the support comprises an arm orientable in rotation around an axis parallel to the axis of the barrel of the firearm.

4. Accessory according to claim 3, wherein which support comprises a lock for locking the orientation of the arm.

5. Accessory according to claim 1, wherein the mounting support comprises an element from amongst a star wheel or a notch, and the mounting plate comprises the other element from amongst the star wheel or the notch, the notch engaging between two teeth of the star wheel to define several respective positions around an axis parallel to the axis of the barrel of the firearm.

6. Accessory according to claim 1, wherein the mechanical connection between the mounting support and the mounting plate is a screw fastening, the mounting support and/or the mounting plate having at least three openings for the passage of screws.

7. Accessory according to claim 1, wherein the support of the magnet bears at least one magnet in rotation around an axis of rotation parallel to the axis of the barrel of the firearm.

8. Firearm comprising a casing ejection window defining a path of a casing ejected from the firearm upon firing, which firearm comprises:

a permanent magnet, and a support configured to position a surface of the permanent magnet in the path of the casing or tangentially to the path of the casing, which support comprises a mounting plate attached to the firearm and a removable mounting support bearing the magnet, the mounting support being configured to be secured to the mounting plate in several respective positions along an axis parallel to the axis of the barrel of the firearm, the mounting support being configured to be secured to the mounting plate in several respective positions in a plane perpendicular to the axis of the barrel of the firearm.

* * * * *